US008428281B2

(12) United States Patent
Song et al.

(10) Patent No.: US 8,428,281 B2
(45) Date of Patent: Apr. 23, 2013

(54) SMALL HEARING AID

(75) Inventors: Jong-keun Song, Yongin-si (KR); Dong-wook Kim, Seoul (KR); Yoon-seo Koo, Seoul (KR)

(73) Assignee: Samsung Electronics Co., Ltd. (KR)

( * ) Notice: Subject to any disclaimer, the term of this patent is extended or adjusted under 35 U.S.C. 154(b) by 192 days.

(21) Appl. No.: 12/985,800

(22) Filed: Jan. 6, 2011

(65) Prior Publication Data

US 2011/0188687 A1 Aug. 4, 2011

(30) Foreign Application Priority Data

Feb. 1, 2010 (KR) ..... 10-2010-0009161

(51) Int. Cl.
*H04R 25/00* (2006.01)

(52) U.S. Cl.
USPC ..... 381/324; 381/328

(58) Field of Classification Search ..... 381/312, 381/324, 328, 330; 600/545, 301; 455/556.1, 455/556.2, 557, 3.06, 41.2, 553.1
See application file for complete search history.

(56) References Cited

U.S. PATENT DOCUMENTS 6,664,713 B2 * 12/2003 Boesen ..... 381/312
6,879,695 B2 4/2005 Maltan et al.
7,142,682 B2 * 11/2006 Mullenborn et al. ..... 381/324
7,292,700 B1 11/2007 Engbert et al.
7,352,876 B2 4/2008 Boor et al.
7,825,509 B1 * 11/2010 Baumhauer et al. ..... 257/724
2008/0137892 A1 6/2008 Shennib et al.
2009/0074220 A1 3/2009 Shennib

FOREIGN PATENT DOCUMENTS

KR 100736894 B1 7/2007

* cited by examiner

*Primary Examiner* — Brian Ensey
(74) *Attorney, Agent, or Firm* — Cantor Colburn LLP

(57) ABSTRACT

A hearing aid comprises a microelectromechanical systems microphone which receives inputs of external sound signals, converting the sound signals to analog signals, and outputting the analog signals; a hearing aid processor chip which converts the analog signals to digital signals, performs gain correction and digital signal processing to the digital signals, and converts the processed digital signals to analog signals; and a microelectromechanical system receiver which outputs the analog signals converted from the processed digital signals as sound signals, wherein the microelectromechanical system microphone is attached to a first surface of the hearing aid processor chip, and the microelectromechanical system receiver is attached to a second surface of the hearing aid processor chip, so that the microelectromechanical system microphone, the hearing aid processor chip, and the microelectromechanical system receiver are integrated as a single body.

22 Claims, 7 Drawing Sheets

SMALL HEARING AID

CROSS-REFERENCE TO RELATED APPLICATIONS

This application claims priority to Korean Patent Application No. 10-2010-0009161, filed on Feb. 1, 2010, and all the benefits accruing therefrom under 35 U.S.C. §119, the content of which in its entirety is herein incorporated by reference.

BACKGROUND

1) Field

The following disclosure generally relates to small hearing aids.

2) Description of the Related Art

A hearing aid typically receives incident sound waves via a microphone, converts the received sound waves into electrical signals, amplifies the electrical signals, and converts the amplified electrical signals to sound waves which are then heard by a user. As electronic technologies are developed, hearing aids are improved using integrated circuits ("ICs") instead of transistors. Along with a development of IC technology and fitting technology for hearing aids, it has become possible to provide gains and outputs according to various types, forms, and degrees of hearing loss, so that a reproduced sound signal can be substantially equated to an original sound signal, Furthermore, sizes of hearing aids are significantly reduced, and various types of hearing aids including a glass type hearing aid attached to a pair of glasses, a hairpin type, a tie pin type, an in-pocket type, a behind-the-ear ("BTE") type, for example, are being manufactured and sold. Generally, a completely-in-the-canal ("CIC") hearing aid, which can be easily inserted completely into user's ear, is popularly used.

SUMMARY

Additional aspects will be set forth in part in the description which follows and, in part, will be apparent from the description, or may be learned by practice of the presented embodiments.

According to an aspect of the present disclosure, a hearing aid includes a microelectromechanical system ("MEMS") microphone for receiving inputs of external sound signals, converting the sound signals to analog signals, and outputting the analog signals; a hearing aid processor chip for converting the analog signals to digital signals, performing gain correction and digital signal processing to the digital signals, and converting the processed digital signals to analog signals; and a MEMS receiver for outputting the analog signals converted from the processed digital signals as sound signals, wherein the MEMS microphone is disposed to a first surface of the hearing aid processor chip, and the MEMS receiver is disposed to a second surface of the hearing aid processor chip, so that the MEMS microphone, the hearing aid processor chip, and the MEMS receiver may be integrated as a single body.

In one exemplary embodiment, the hearing aid processor chip may includes a preamplifier for amplifying the analog signals output by the MEMS microphone; an analog-to-digital converter ("ADC") for converting the analog signals amplified by the preamplifier to digital signals; a signal processor for performing gain correction and digital signal processing with respect to the digital signals converted from the analog signals by the ADC; a digital-to-analog converter ("DAC") for converting the digital signals processed by the signal processor to analog signals; and an amplifier for amplifying the analog signals converted from the digital signals by the DAC.

In one exemplary embodiment, each of the MEMS microphone and the MEMS receiver may include a plurality of transducer cells, each of which may include a substrate; a first electrode disposed on the substrate; a plurality of supporting units disposed on the first electrode; a thin film supported by the plurality of supporting units; and a second electrode disposed on the thin film.

In one exemplary embodiment, the plurality of transducer cells may be arranged in an array.

In one exemplary embodiment, a frequency band of the transducer cells may be an audible frequency band, that is, from about 20 hertz (Hz) to about 20,000 Hz.

In one exemplary embodiment, the hearing aid may further include a housing surrounding the hearing aid; and a plurality of fixing units disposed to an outer surfaces of the housing.

In one exemplary embodiment, the hearing aid may further include a printed circuit board ("PCB") in which a groove is formed, wherein the hearing aid processor chip may be disposed to the bottom surface of the groove formed in the PCB, the MEMS microphone may be disposed to a first surface of the PCB, and the MEMS receiver may be disposed to a second surface of the PCB.

In one exemplary embodiment, the hearing aid may further include a housing surrounding the hearing aid; and a plurality of fixing units disposed to the outer surfaces of the housing.

According to another aspect of the present disclosure, a hearing aid includes a PCB; a MEMS microphone chip, which is disposed on a first surface of the PCB, receives inputs of external sound signals, converts the sound signals to analog signals, and outputs the analog signals; a hearing aid processor chip, which is disposed on the first surface of the PCB, converts the analog signals to digital signals, performs gain correction and digital signal processing to the digital signals, and converts the processed digital signals to analog signals; and a MEMS receiver chip, which is disposed on a second surface of the PCB and outputs the analog signals converted from the processed digital signals as sound signals, wherein the MEMS microphone chip, the hearing aid processor chip, and the MEMS receiver chip are disposed on the single PCB.

In one exemplary embodiment, each of the MEMS microphone chip and the MEMS receiver chip may include a plurality of transducer cells, each of which includes a substrate; a first electrode disposed on the substrate; a plurality of supporting units disposed on the first electrode; a thin film supported by the plurality of supporting units; and a second electrode disposed on the thin film.

In one exemplary embodiment, the plurality of transducer cells may be arranged in an array.

In one exemplary embodiment, a frequency band of the transducer cells may be an audible frequency band, that is, from about 20 Hz to about 20,000 Hz.

According to an aspect of the present disclosure, a hearing aid includes a substrate; a MEMS microphone, which is disposed on a first surface of the substrate, receives inputs of external sound signals, converts the sound signals to analog signals, and outputs the analog signals; a hearing aid processor chip, which is disposed on the first surface of the substrate, converts the analog signals to digital signals, performs gain correction and digital signal processing to the digital signals, and converts the processed digital signals to analog signals; and a MEMS receiver, which is disposed on a second surface of the substrate and outputs the analog signals converted from the processed digital signals as sound signals, wherein the MEMS microphone, the hearing aid processor chip, and the MEMS receiver are disposed on the single substrate.

In one exemplary embodiment, the hearing aid processor chip may include a preamplifier for amplifying the analog signals output by the MEMS microphone; an ADC for converting the analog signals amplified by the preamplifier to digital signals; a signal processor for performing gain correction and digital signal processing to the digital signals with respect to the digital signals converted from the analog signals by the ADC; a DAC for converting the digital signals processed by the signal processor to analog signals; and an amplifier for amplifying the analog signals converted from the digital signals by the DAC.

In one exemplary embodiment, each of the MEMS microphone and the MEMS receiver includes transducer cells, each of which includes a substrate; a first electrode disposed on the substrate; a plurality of supporting units disposed on the first electrode; a thin film supported by the plurality of supporting units; and a second electrode disposed on the thin film.

In one exemplary embodiment, a plurality of transducer cells may be arranged in an array.

In one exemplary embodiment, a frequency band of the transducer cells may be an audible frequency band, that is, from about 20 Hz to about 20,000 Hz.

In one exemplary embodiment, the hearing aid may further include a housing surrounding the hearing aid; and a plurality of fixing units disposed to the outer surfaces of the housing.

BRIEF DESCRIPTION OF THE DRAWINGS

The above and other aspects, advantages and features of this disclosure will become more apparent by describing in further detail embodiments thereof with reference to the accompanying drawings, in which.

DETAILED DESCRIPTION

Figure 1:
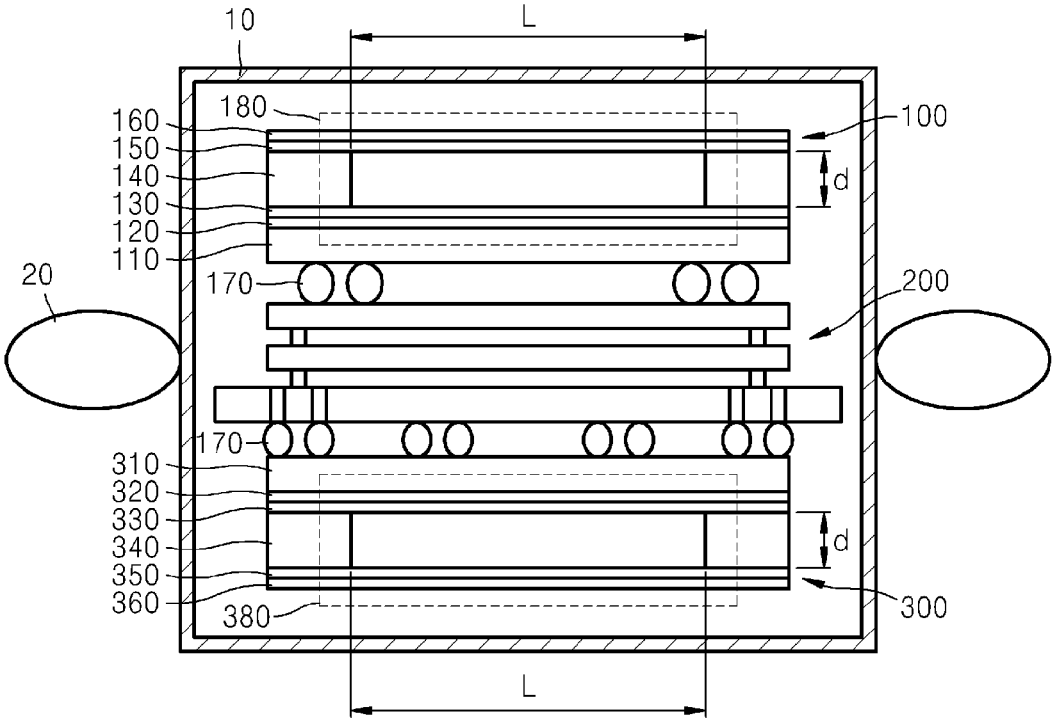
FIG. 1 is a schematic diagram of an embodiment of a small hearing aid.

Various exemplary embodiments will now be described more fully with reference to the accompanying drawings in which some exemplary embodiments are shown.

Detailed illustrative exemplary embodiments are disclosed herein. However, specific structural and functional details disclosed herein may be merely representative for purposes of describing exemplary embodiments. This disclosure, however, may be embodied in many alternate forms and should not be construed as limited to only the exemplary embodiments set forth herein.

Accordingly, while exemplary embodiments are capable of various modifications and alternative forms, embodiments thereof are shown by way of example in the drawings and will herein be described in detail. It should be understood, however, that there is no intent to limit exemplary embodiments to the particular forms disclosed, but on the contrary, exemplary embodiments are to cover all modifications, equivalents, and alternatives falling within the scope of the disclosure. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of exemplary embodiments. As used herein, the term "and/or," includes any and all combinations of one or more of the associated listed items.

It will be understood that when an element or layer is referred to as being "formed on," another element or layer, it can be directly or indirectly formed on the other element or layer. That is, for example, intervening elements or layers may be present. In contrast, when an element or layer is referred to as being "directly formed on," to another element, there are no intervening elements or layers present. Other words used to describe the relationship between elements or layers should be interpreted in a like fashion (e.g., "between," versus "directly between," "adjacent," versus "directly adjacent," etc.).

The terminology used herein is for the purpose of describing particular embodiments only and is not intended to be limiting of exemplary embodiments. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

In the drawings, thicknesses of layers and regions may be exaggerated for clarity. Like reference numerals in the drawings are used to denote like elements.

Hereinafter, exemplary embodiments of the present disclosure will be described in detail with reference to the accompanying drawings.

Figure 2:
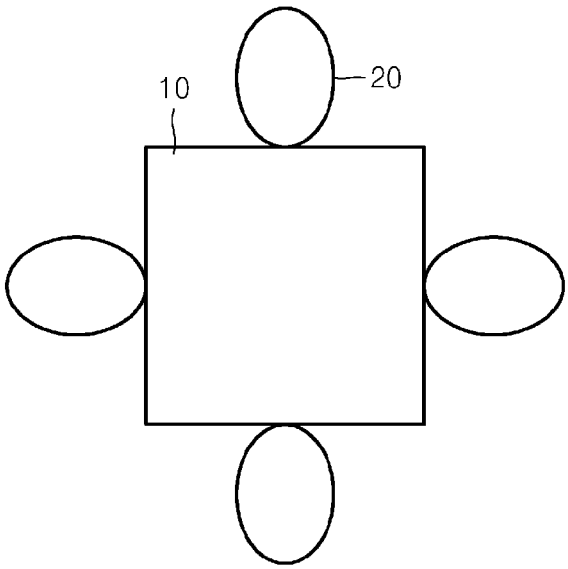
FIG. 2 is a top plan view of an embodiment of a hearing aid according to the present disclosure.
Figure 3:
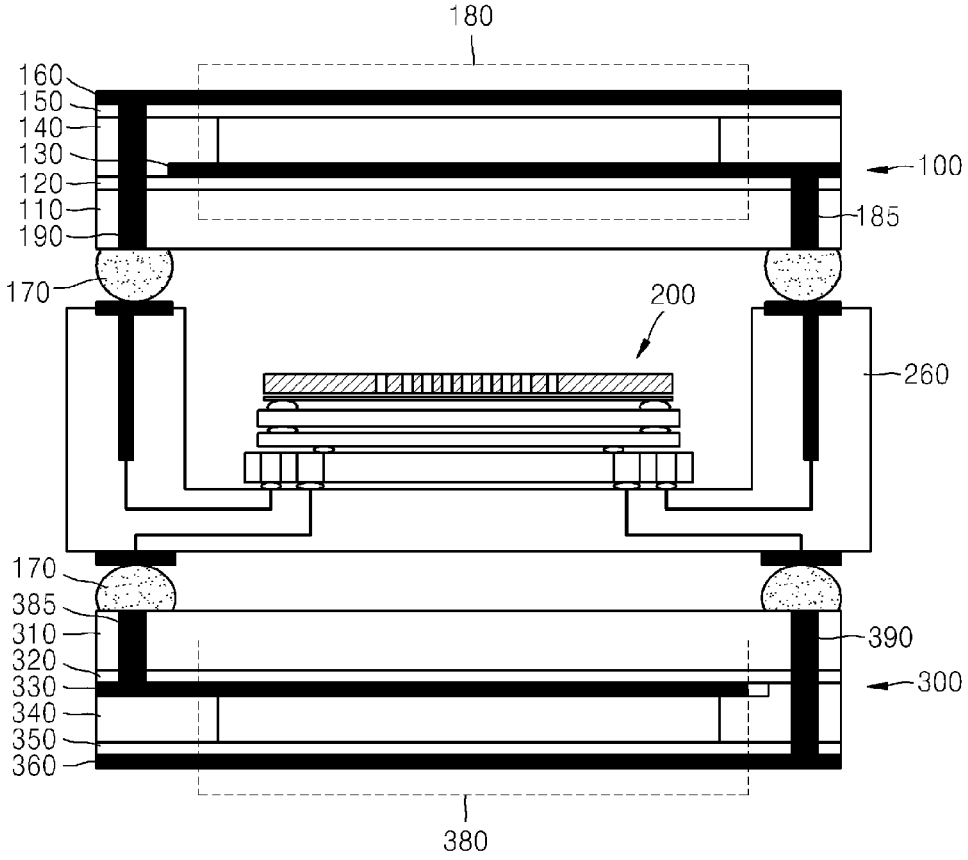
FIG. 3 is a cross sectional view of an embodiment of the hearing aid comprising a microelectro-mechanical system ("MEMS") microphone and a MEMS receiver.

FIGS. 1 and 3 are sectional views showing an exemplary embodiment of a structure of a small hearing aid. In the exemplary embodiment of the small hearing aid, a microelectro-mechanical system ("MEMS") microphone 100, a hearing aid processor chip 200, and a MEMS receiver 300 are integrated as a single body. FIG. 2 is a top plan view of the exemplary embodiment of the small hearing aid.

Referring to FIG. 1, a plurality of ball bumps 170 is disposed (e.g., attached) between the MEMS microphone 100 and the hearing aid processor chip 200, and between the hearing aid processor chip 200 and the MEMS receiver 300, respectively, The integrated small hearing aid including the plurality of ball bumps 170, the MEMS microphone 100, the hearing aid processor chip 200, and the MEMS receiver 300 may be disposed in a housing 10. In one exemplary embodiment, the small hearing aid may be fixed to an inside of the housing 10. Although FIG. 1 depicts that the MEMS microphone 100 and the MEMS receiver 300 are housed in the housing 10, in one exemplary embodiment, the MEMS microphone 100 and the MEMS receiver 300 may be exposed to outside of the housing 10. A plurality of fixing units 20 may be disposed on outer surfaces of the housing 10. The small hearing aid may be easily fixed in user's ear using the plurality of fixing units 20, and may substantially be prevented from moving, such as swinging or rotating by external shock, for example. Further, as shown in FIG. 2, the small hearing aid may be prevented from completely blocking the ears, thereby avoiding an occlusion effect using the plurality of fixing unit 20. Numbers and shapes of the plurality of fixing units 20 disposed to the housing 10 disclosed in the exemplary embodiment are not limited thereto and different numbers and shapes of fixing units may be used. The MEMS microphone 100 receives external sound signals, converts the received sound signals to analog signals, and outputs the analog signals. The hearing aid processor chip 200 converts the analog signals output by the MEMS microphone 100 to digital signals, performs gain correction and digital signal processing to the digital signals, and converts the processed digital signals to analog signals. The MEMS receiver 300 outputs the analog signals converted from the processed digital signals as sound signals.

Figure 4:
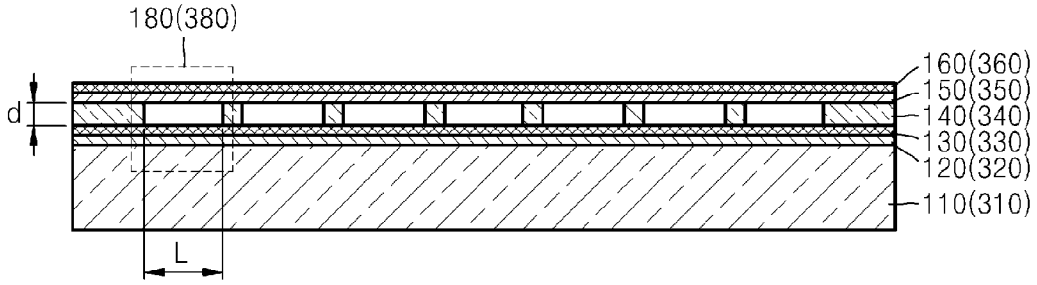
FIG. 4 is a cross sectional view of an embodiment of an array of multi-transducer cell.

FIG. 4 is a sectional view of an exemplary embodiment of an array of transducer cells 180 and 380 of the MEMS microphone 100 and the MEMS receiver 300, according to the present disclosure.

Referring to FIGS. 1 and 4, the MEMS microphone 100 and the MEMS receiver 300 are fabricated in a MEMS process. The MEMS microphone 100 and the MEMS receiver 300 may include the transducer cells 180 and 380, respectively, which include substrates 110 and 310, dielectric material layers 120 and 320, first electrodes 130 and 330, supporting units 140 and 340, thin films 150 and 350, and second electrodes 160 and 360, respectively. In the transducer cells 180 and 380, the dielectric material layers 120 and 320 are disposed on the substrates 110 and 310, respectively and the first electrodes 130 and 330 are disposed on the dielectric material layers 120 and 320, respectively. The supporting units 140 and 340 are disposed on the first electrodes 130 and 330, respectively, and the supporting units 140 and 340 support the thin films 150 and 350, respectively, that are disposed on an upper side of the supporting units 140 and 340, respectively. In one exemplary embodiment, the supporting units 140 and 340 may be disposed on the substrates 110 and 310, or on the dielectric material layers 120 and 320, respectively, when the first electrodes 130 and 330 are disposed on a part of the substrates 110 and 130, respectively. The second electrodes 160 and 360 are disposed on the thin films 150 and 350, respectively. The transducer cells 180 and 380 of the MEMS microphone 100 and the MEMS receiver 300, respectively, may have a substantially same structure but may function substantially differently. The transducer cell 180 of the MEMS microphone 100 receives sound signals from outside, whereas the transducer cell 380 of the MEMS receiver 300 outputs sound signals to outside. An upper surface of the thin film 150 of the MEMS microphone 100 and an upper surface of the thin film 350 of the MEMS receiver 300 may face substantially opposite directions. That is, the upper surface of the thin film 150 of the MEMS microphone 100 may face toward outside of user's earhole, whereas the upper surface of the thin film 350 of the MEMS receiver 300 may face toward user's eardrum, for example.

The substrates 110 and 310 may include silicon or quartz for a MEMS process. The dielectric material layers 120 and 320 are disposed on the substrates 110 and 310, respectively, where the dielectric material layers 120 and 320 are layers for insulating the substrates 110 and 310 and the first electrodes 130 and 330 from each other, respectively, and may include silicon layers, oxide layers, or nitride layers or layers with other materials with similar characteristics. The first electrodes 130 and 330 and the second electrodes 160 and 360 are conductors for applying an electric potential between the substrate 110 and the thin film 150, and between the substrate 310 and the thin film 350, respectively, and may include a metal such as aluminum or gold, or a densely doped polysilicon. Frequency characteristics relative to vibration of the thin films 150 and 350 may be adjusted by changing a distance d between the first electrode 130 and the thin film 150, and between the first electrode 330 and the thin film 350, respectively, and a length L of the thin films 150 and 350, materials constituting the thin films 150 and 350, and a thickness of the thin films 150 and 350. An elasticity coefficient of the thin films 150 and 350 varies according to materials constituting the thin films 150 and 350.

The transducer cells 180 and 380 may receive input sound signals or output sound signals in an audible frequency band, which is from about 20 Hz to about 20,000 Hz, using a micromachined ultrasonic transducer ("MUT"). The transducer cells 180 and 380 may receive the input sound signals or the output sound signals using a following mechanism.

First, when the transducer cell 180 receives input of external sound signals, direct current is applied to the first and second electrodes 130 and 160. When the direct current is applied to the first and second electrodes 130 and 160, a displacement of the thin film 150 is induced. If external sound signals are input when the displacement of thin film 150 is induced, the displacement of the thin film 150 is changed according to a sound pressure of the sound signals. Due to the displacement of the thin film 150, a capacitance of the transducer cell 180 is changed. The input of sound signals may be received by detecting the change of the capacitance of the transducer cell 180. When the transducer cell 380 outputs sound signals, direct current is applied to the first and second electrodes 330 and 360. When the direct current is applied to the first and second electrodes 330 and 360, the substrate 310 and the thin film 350 form a capacitor. When the direct current is applied to the first and second electrodes 330 and 360, the displacement of the thin film 350 is induced by an electrostatic force and the thin film 350 is pulled toward the first electrode 330. Here, the displacement of the thin film 350 stops at a point where the electrostatic force equals to a drag due to an internal stress of the thin film 350. At this point, if an alternating current is applied thereto, the thin film 350 is vibrated and outputs sound signals.

Depending on a sensitivity of the MEMS microphone 100 or output power of the MEMS receiver 300, the transducer cells 180 and 380 may be a single transducer cell, respectively, as shown in FIG. 1 or multi-transducer cells having a shape of an m×n array (m and n are natural numbers) as shown in FIG. 4. In further exemplary embodiment, a multi-transducer cell may be arranged in various types of arrays. When the transducer cells 180 and 380 are multi-transducer cells as shown in FIG. 4, the sensitivity of the MEMS microphone 100 and the output of the MEMS receiver 300 may be improved.

The hearing aid processor chip 200 may be a single chip when the hearing aid processor chip 200 is a system-on-chip ("SOC"). Alternatively, as shown in FIG. 1, a plurality of chips may be arranged in multiple layers as a system in package ("SIP"). Referring to FIG. 3, the hearing aid processor chip 200 may be disposed to the bottom of a groove formed in a printed circuit board ("PCB") 260. In one exemplary embodiment, the MEMS microphone 100 may be disposed to a first surface of the PCB 260 via the ball bumps 170, for example, but is not limited thereto. In one exemplary embodiment, the MEMS receiver 300 may be disposed to a second surface of the PCB 260 via the ball bumps 170, for example, but is not limited thereto. The first electrodes 130 and 330 and the second electrodes 160 and 360 of the MEMS microphone 100 and MEMS receiver 300, respectively, may be electrically connected to the PCB 260 via through-wafer via holes 185, 190, 385, and 390. The hearing aid processor chip 200 may be electrically connected to the MEMS microphone 100 and the MEMS receiver 300 via a wiring layer in the PCB 260. In one exemplary embodiment, the groove (not shown) of the PCB 260 may be covered by another substrate.

Figure 5:
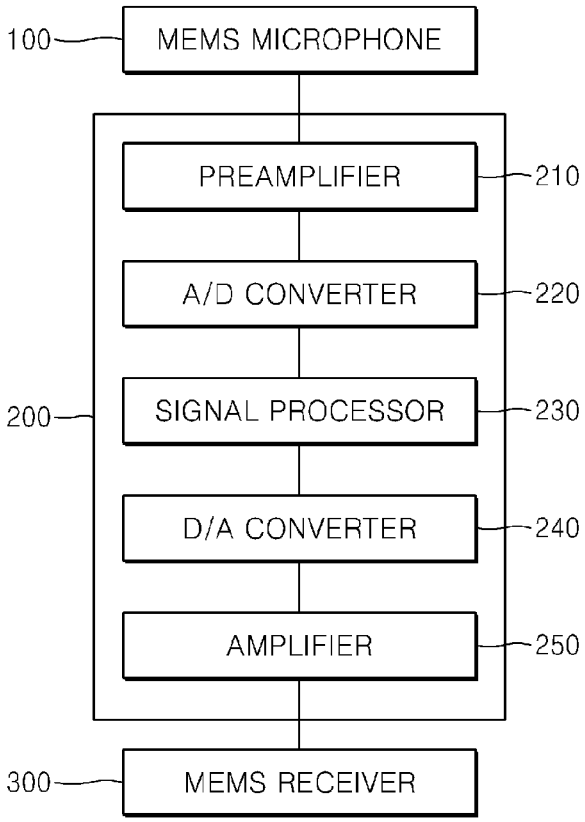
FIG. 5 is a block diagram for describing an embodiment of operations of each of components included in a small hearing aid, according to the present disclosure.

FIG. 5 is a block diagram depicting an exemplary embodiment of operations of each of the components of a small hearing aid, according to the present disclosure.

Referring to FIG. 5, the hearing aid processor chip 200 may include a preamplifier 210, an analog-to-digital converter ("ADC") 220, a signal processor 230, a digital-to-analog converter ("DAC") 240, and an amplifier 250. The preamplifier 210 amplifies analog signals output by the MEMS microphone 100. The ADC 220 converts analog signals amplified by the preamplifier 210 to digital signals. The signal processor 230 performs gain correction and digital signal processing with respect to the digital signals, which were converted from analog signals by the ADC 220, using a preset signal processing algorithm. The signal processor 230 may perform signal processing to each of bands of the digital signals according to the preset signal processing algorithm. The DAC 240 converts digital signals processed by the signal processor 230 to analog signals. The amplifier 250 amplifies analog signals, which were converted from digital signals by the DAC 240. In one exemplary embodiment, the hearing aid processor chip 200 may further include a communication module (not shown) for human body communication, frequency modulation ("FM") communication, or Bluetooth communication, for example. The communication module may be disposed outside of ears, and connected to the hearing aid processor chip 200.

Although not shown, an exemplary embodiment of the small hearing aid according to the present disclosure may further include a battery for supplying power to the MEMS microphone 100, the hearing aid processor chip 200, and the MEMS receiver 300. In one exemplary embodiment, the battery may be located outside of ears and connected to the hearing aid processor chip 200 with wires or wireless, or may be located between the MEMS microphone 100 and the hearing aid processor chip 200.

In a typical hearing aid, a hearing aid processor chip and a receiver are separated components. Therefore, an assembly process is complicated, and a volume of a hearing aid is substantially large. As a size of a hearing aid increases, it becomes more difficult to locate a receiver close to the eardrum. Accordingly, it is beneficial to generate a greater sound pressure when a receiver is located close to the eardrum to vibrate a diaphragm of the eardrum as a distance between a receiver and the eardrum increases. As a result, a receiver requires greater output power, and thus more electricity is consumed to generate a receiver with higher output power. Furthermore, when a microphone is located outside the earhole, the microphone is exposed to various environmental noises, such as wind noises, directionality, external shocks, for example. Therefore, a separate algorithm is necessary to remove the environmental noises, and additional electricity is consumed to drive the algorithm.

The size of the exemplary embodiment of the small hearing aid according to the present disclosure may be reduced to several millimeters by attaching the MEMS microphone 100 and the MEMS receiver 300 to both surfaces of the hearing aid processor chip 200 in a MEMS process. Furthermore, by locating the MEMS receiver 300 as close to the eardrum as possible, necessary output power of the MEMS receiver 300 may be minimized to minimize electricity consumption of the hearing aid processor chip 200. Furthermore, since the MEMS microphone 100 may be located deep in the earhole, the MEMS microphone 100 is not exposed to various environmental noises, and may utilize natural sound pressure amplifiers, such as an earflap.

Figure 6A:
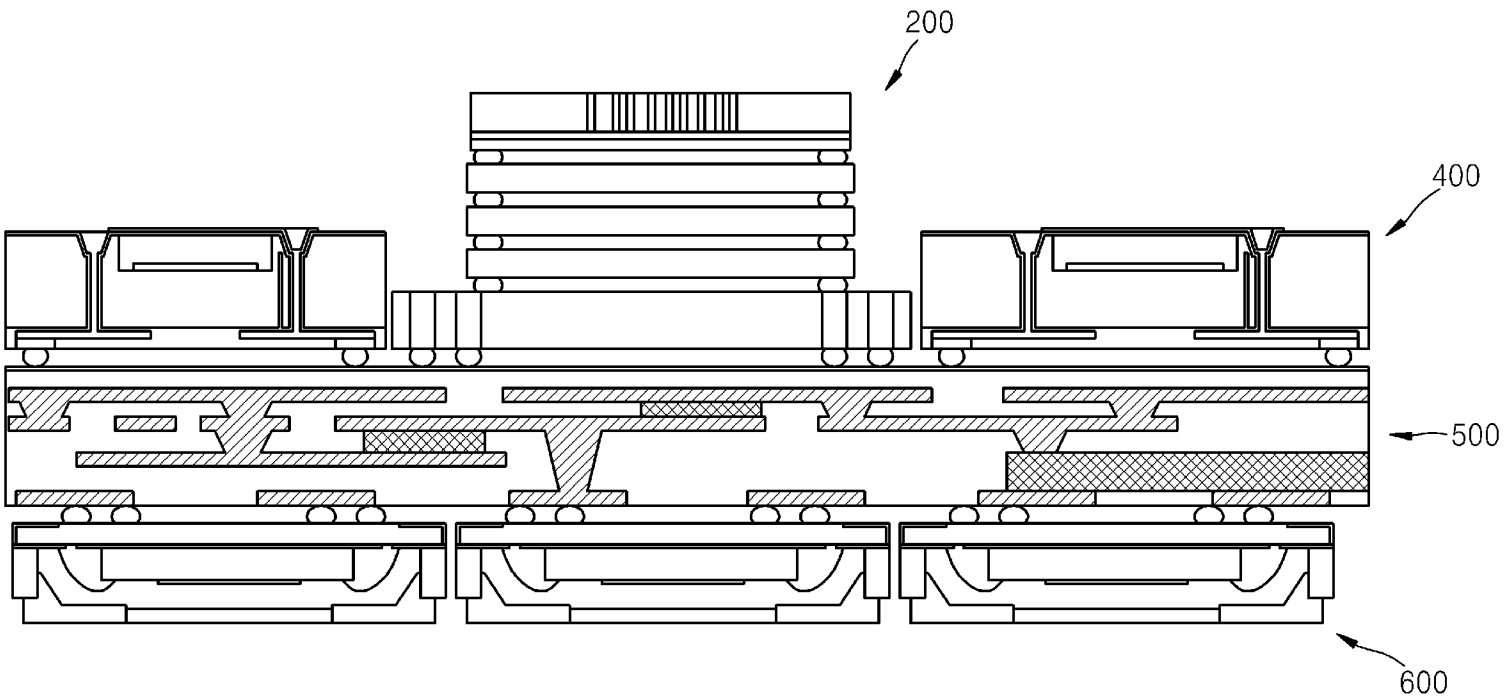
FIG. 6A is a cross sectional view showing an embodiment of a structure of a small hearing aid according to the present disclosure.
Figure 6B:
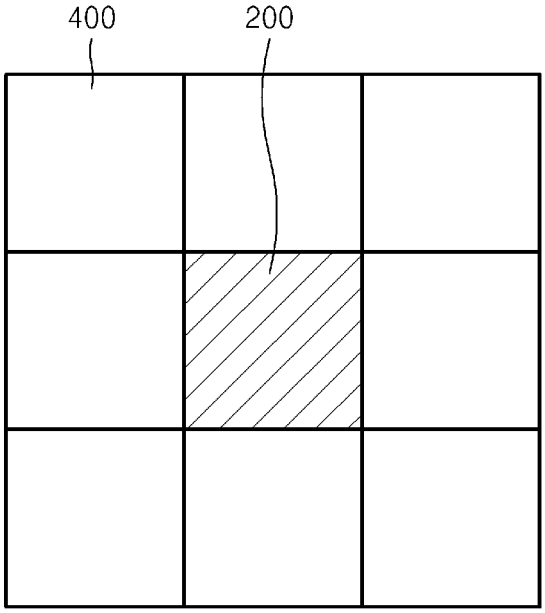
FIG. 6B is a top plan view of the embodiment of the small hearing aid of FIG. 6A.

FIG. 6A is a sectional view showing the structure of a small hearing aid according to another embodiment of the present disclosure, and FIG. 6B is a plan view of the small hearing aid of FIG. 6A.

Referring to FIG. 6A, MEMS microphone chips 400 and the hearing aid processor chip 200 are disposed (e.g., mounted) on a first surface of a PCB 500. Furthermore, MEMS receiver chips 600 are disposed on a second surface of the PCB 500. The MEMS microphone chip 400 is an on-chip embodiment of the MEMS microphone 100 shown in FIG. 1. Furthermore, the MEMS receiver chip 600 is an on-chip embodiment of the MEMS receiver 300 shown in FIG. 1. In one exemplary embodiment, the PCB 500 may be a multi-layer PCB. In one exemplary embodiment, the multi-layer PCB is fabricated by combining a plurality of thin etched substrates, where a wiring layer is integrated in the multi-layer PCB. In one exemplary embodiment, the multi-layer PCB may be designed to have any of various structures.

Referring to FIG. 6B, the MEMS microphone chips 400 are disposed on a first surface of the PCB 500 as a 3×3 array, and the hearing aid processor chip 200 is disposed on a center cell of the 3×3 array. Although the 3×3 array of the MEMS microphone chip 400s are shown in FIG. 6B, the MEMS microphone chips 400 may be disposed on the first surface of the PCB 500 in an m×n array, where m and n are natural numbers. The hearing aid processor chip 200 may be located in any of cells of the m×n array. The hearing aid processor chip 200 may also occupy a plurality of cells of the m×n array. The MEMS receiver chips 600 may also be disposed on the second surface of the PCB 500 in an m×n array. Furthermore, the MEMS microphone chips 400 and the MEMS receiver chips 600 may be arranged in any of various types of arrays. The small hearing aid according to the present embodiment may be fabricated by automatically mounting the MEMS microphone chip 400s, the hearing aid processor chip 200, and the MEMS receiver chips 600, which are embodied as chips, on the PCB 500 using an automated equipment. Therefore, automated fabrication and miniaturization of a hearing aid may be achieved.

Figure 7A:
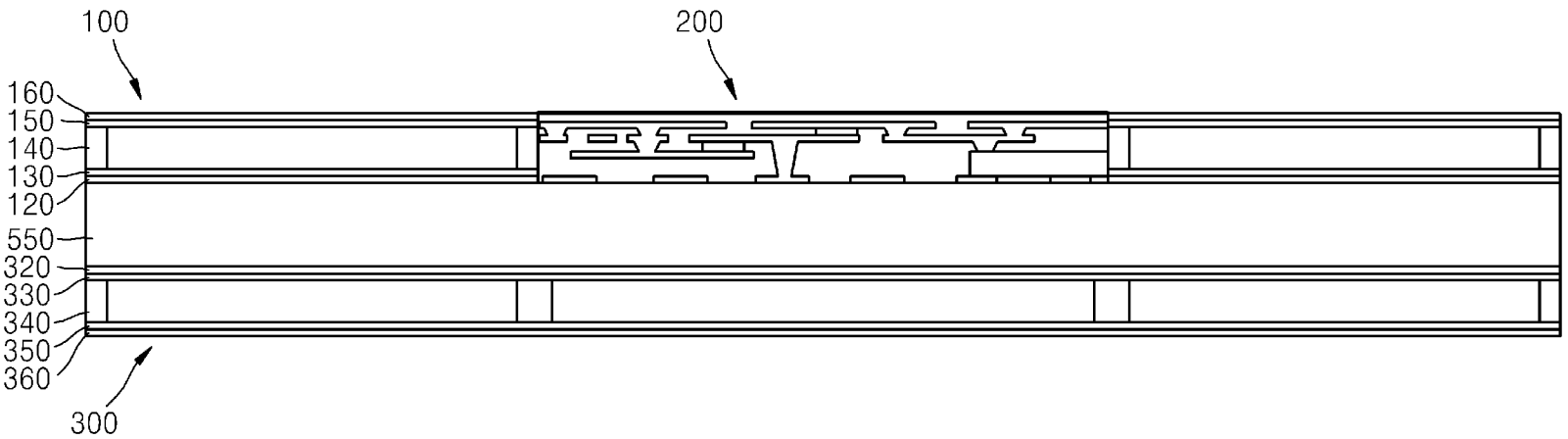
FIG. 7A is a cross sectional view showing an embodiment of the structure of a small hearing aid according to the present disclosure.
Figure 7B:
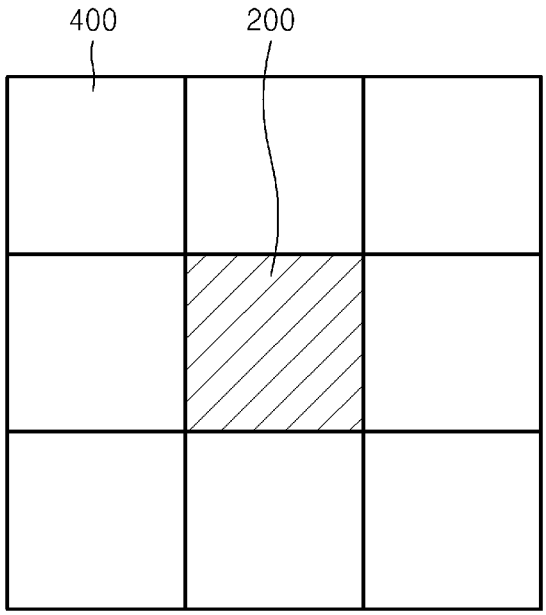
FIG. 7B is a top plan view of the embodiment of the small hearing aid of FIG. 7A.

FIG. 7A is a sectional view depicting another embodiment of the structure of a small hearing aid according the present disclosure, and FIG. 7B is a plan view of the exemplary embodiment o the small hearing aid of FIG. 7A.

Referring to FIG. 7A, the MEMS microphones 100 and the hearing aid processor chip 200 are disposed on a first surface of a substrate 550. The MEMS receivers 300 may be disposed on a second surface of the substrate 550. In FIG. 7B, the MEMS microphones 100 may be disposed in a 3×3 array, and the hearing aid processor chip 200 is disposed in a center cell of the 3×3 array. In one exemplary embodiment, the hearing aid processor chip 200 may be a multi-layer PCB. Although the 3×3 array of the MEMS microphones 100 is shown in FIG. 7B, the MEMS microphones 100 may be arranged on the first surface of the substrate 550 in an m×n array, where m and n are natural numbers. The hearing aid processor chip 200 may be located in any of cells of the m×n array. The hearing aid processor chip 200 may also occupy a plurality of cells of the m×n array. In FIG. 7B, the MEMS receivers 300 are arranged in a 3×3 array, but the MEMS receiver 300 may also be arranged in an m×n array, where m and n are natural numbers. Furthermore, the MEMS microphones 100 and the MEMS receivers 300 may be arranged in any of various types of arrays.

The hearing aid processor chip 200 may be disposed (e.g., formed) on the first surface of the substrate 550 in a complementary metal-oxide-semiconductor ("CMOS") process, and the MEMS microphone 100 may be formed on the first surface in a semiconductor process. The MEMS receiver 300 may also be disposed on the second surface of the substrate 550 in a semiconductor process. In one exemplary embodiment, the substrate 550 may include silicon, for example. As the MEMS microphone 100, the hearing aid processor chip 200, and the MEMS receiver 300 are disposed on both surfaces of the substrate 550, a post process for interconnecting the MEMS microphone 100 and the MEMS receiver 300 to the hearing aid processor chip 200 may be omitted. In the exemplary embodiment of the small hearing aid shown in FIG. 6A, the MEMS microphone chip 400, the hearing aid processor chip 200, and the MEMS receiver chip 600 are separately fabricated and disposed on the PCB 500. However, in the exemplary embodiment of the small hearing aid shown in FIG. 7A, the MEMS microphone 100, the hearing aid processor chip 200, and the MEMS receiver 300 are disposed on both surfaces of the substrate 550 in a CMOS process and in a semiconductor process.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A hearing aid comprising:

a microelectromechanical system microphone which receives inputs of external sound signals, converting the sound signals to analog signals, and outputting the analog signals;

a hearing aid processor chip which converts the analog signals to digital signals, performs gain correction and digital signal processing to the digital signals, and converts the processed digital signals to analog signals; and a microelectromechanical system receiver which outputs the analog signals converted from the processed digital signals as sound signals, wherein the microelectromechanical system microphone is disposed to a first surface of the hearing aid processor chip, and the microelectromechanical system receiver is disposed to a second surface of the hearing aid processor chip, so that the microelectromechanical system microphone, the hearing aid processor chip, and the microelectromechanical system receiver are integrated as a single body.

2. The hearing aid of claim 1, wherein the hearing aid processor chip further comprises:

a preamplifier which amplifies the analog signals output by the microelectromechanical system microphone;

an analog-to-digital converter which converts the analog signals amplified by the preamplifier to digital signals;

a signal processor which performs gain correction and digital signal processing with respect to the digital signals converted from the analog signals by the analog-to-digital converter;

a digital-to-analog converter which converts the digital signals processed by the signal processor to analog signals; and an amplifier which amplifies the analog signals converted from the digital signals by the digital-to-analog converter.

3. The hearing aid of claim 1, wherein each of the microelectromechanical system microphone and the microelectromechanical system receiver further comprises a plurality of transducer cells, each of the plurality of transducer cells comprises:

a substrate;

a first electrode disposed on the substrate;

a plurality of supporting units disposed on the first electrode;

a thin film supported by the plurality of supporting units; and a second electrode disposed on the thin film.

4. The hearing aid of claim 3, wherein the plurality of transducer cells is arranged in an array.

5. The hearing aid of claim 3, wherein a frequency band of the plurality of transducer cells is an audible frequency band, that is, from about 20 hertz to about 20,000 hertz.

6. The hearing aid of claim 1, further comprising:

a housing which surrounds the hearing aid; and a plurality of fixing units disposed to outer surfaces of the housing.

7. A hearing aid comprising:

a printed circuit board in which a groove is formed;

a microelectromechanical system microphone which receives inputs of external sound signals, converts the sound signals to analog signals, and outputs the analog signals;

a hearing aid processor chip which converts the analog signals to digital signals, performs gain correction and digital signal processing to the digital signals, and converts the processed digital signals to analog signals; and a microelectromechanical system receiver which outputs the analog signals converted from the processed digital signals as sound signals, wherein the hearing aid processor chip is disposed to the bottom surface of the groove formed in the printed circuit board;

the microelectromechanical system microphone is disposed to a first surface of the printed circuit board, and the microelectromechanical system receiver is disposed to a second surface of the printed circuit board, so that the microelectromechanical system microphone, the hearing aid processor chip, the printed circuit board, and the microelectromechanical system receiver are integrated as a single body.

8. The hearing aid of claim 7, wherein each of the microelectromechanical system microphone and the microelectromechanical system receiver comprises a plurality of transducer cells, each of which comprises:

a substrate;

a first electrode disposed on the substrate;

a plurality of supporting units disposed on the first electrode;

a thin film supported by the plurality of supporting units; and a second electrode disposed on the thin film.

9. The hearing aid of claim 8, wherein the plurality of transducer cells is arranged in an array.

10. The hearing aid of claim 8, wherein a frequency band of the plurality of transducer cells is an audible frequency band, that is, from about 20 hertz to about 20,000 hertz.

11. A hearing aid comprising:

a printed circuit board;

a microelectromechanical system microphone chip, which is disposed on a first surface of the printed circuit board, receives inputs of external sound signals, converts the sound signals to analog signals, and outputs the analog signals;

a hearing aid processor chip, which is disposed on the first surface of the printed circuit board, converts the analog signals to digital signals, performs gain correction and digital signal processing to the digital signals, and converts the processed digital signals to analog signals; and a microelectromechanical system receiver chip, which is disposed on a second surface of the printed circuit board and outputs the analog signals converted from the processed digital signals as sound signals, wherein the microelectromechanical system microphone chip, the hearing aid processor chip, and the microelectromechanical system receiver chip are disposed on the single printed circuit board.

12. The hearing aid of claim 11, wherein the hearing aid processor chip comprises:

a preamplifier which amplifies the analog signals output by the microelectromechanical system microphone chip;

an analog-to-digital converter which converts the analog signals amplified by the preamplifier to digital signals;

a signal processor which performs gain correction and digital signal processing to the digital signals with respect to the digital signals converted from the analog signals by the analog-to-digital converter;

a digital-to-analog converter which converts the digital signals processed by the signal processor to analog signals; and an amplifier which amplifies the analog signals converted from the digital signals by the digital-to-analog converter.

13. The hearing aid of claim 11, wherein each of the microelectromechanical system microphone chip and the microelectromechanical system receiver chip comprises a plurality of transducer cells, each of which comprises:

a substrate;

a first electrode disposed on the substrate;

a plurality of supporting units disposed on the first electrode;

a thin film supported by the plurality of supporting units; and a second electrode disposed on the thin film.

14. The hearing aid of claim 13, wherein the plurality of transducer cells is arranged in an array.

15. The hearing aid of claim 13, wherein a frequency band of the plurality of transducer cells is an audible frequency band, that is, from about 20 hertz to about 20,000 hertz.

16. The hearing aid of one of claims 11 through 14, further comprising:

a housing which surrounds the hearing aid; and a plurality of fixing units disposed to outer surfaces of the housing.

17. A hearing aid comprising:

a substrate;

a microelectromechanical system microphone, which is disposed on a first surface of the substrate, receives inputs of external sound signals, converts the sound signals to analog signals, and outputs the analog signals;

a hearing aid processor chip, which is disposed on the first surface of the substrate, converts the analog signals to digital signals, performs gain correction and digital signal processing to the digital signals, and converts the processed digital signals to analog signals; and a microelectromechanical system receiver, which is disposed on a second surface of the substrate and outputs the analog signals converted from the processed digital signals as sound signals, wherein the microelectromechanical system microphone, the hearing aid processor chip, and the microelectromechanical system receiver are disposed on the single substrate.

18. The hearing aid of claim 17, wherein the hearing aid processor chip comprises:

a preamplifier which amplifies the analog signals output by the microelectromechanical system microphone;

an analog-to-digital converter which converts the analog signals amplified by the preamplifier to digital signals;

a signal processor which performs gain correction and digital signal processing to the digital signals with respect to the digital signals converted from the analog signals by the analog-to-digital converter;

a digital-to-analog converter which converts the digital signals processed by the signal processor to analog signals; and an amplifier which amplifies the analog signals converted from the digital signals by the digital-to-analog converter.

19. The hearing aid of claim 17, wherein each of the microelectromechanical system microphone and the microelectromechanical system receiver comprises a plurality of transducer cells, each of which comprises:

a substrate;

a first electrode disposed on the substrate;

a plurality of supporting units disposed on the first electrode;

a thin film supported by the plurality of supporting units; and a second electrode disposed on the thin film.

20. The hearing aid of claim 19, wherein the plurality of transducer cells is arranged in an array.

21. The hearing aid of claim 19, wherein a frequency band of the plurality of transducer cells is an audible frequency band, that is, from about 20 hertz to about 20,000 hertz.

22. The hearing aid of claim 17, further comprising:

a housing surrounding the hearing aid; and a plurality of fixing units disposed to outer surfaces of the housing.

* * * * *